United States Patent [19]

Matalia et al.

[11] 4,263,848

[45] Apr. 28, 1981

[54] METHOD AND APPARATUS FOR REDUCING AIR ENTRAPMENT IN ROTARY INKING SYSTEMS

[75] Inventors: Harshad D. Matalia; John L. Newbegin; Frederick L. Warner, all of Easton, Pa.

[73] Assignee: American Newspaper Publishers Association, Easton, Pa.

[21] Appl. No.: 119,694

[22] Filed: Feb. 8, 1980

[51] Int. Cl.[3] ..... B41F 31/06; B41L 27/06

[52] U.S. Cl. ..... 101/350; 101/363; 101/364; 101/426

[58] Field of Search ..... 101/363, 364, 365, 366, 101/350, 148, 206, 207, 208, 209, 210, 211, 426, 157, 169; 118/258, 259, 261

[56] References Cited

U.S. PATENT DOCUMENTS

| | | | |
|---|---|---|---|
| 1,137,856 | 5/1915 | Halliwell | 101/363 |
| 1,497,196 | 6/1924 | Potdevin . | |
| 1,809,159 | 6/1931 | Cornell et al. . | |
| 1,846,856 | 2/1932 | Francis . | |
| 1,883,257 | 10/1932 | Wood . | |
| 2,196,412 | 4/1940 | Grembecki | 101/147 |
| 2,276,662 | 3/1942 | Matuschke | 101/363 |
| 2,366,375 | 1/1945 | Worthington . | |
| 2,967,480 | 1/1961 | Gerard | 101/364 |
| 2,983,222 | 5/1961 | Bakalars | 101/364 |
| 3,009,417 | 11/1961 | Saul | 101/148 |
| 3,025,793 | 3/1962 | Vischulis | 101/350 |
| 3,366,091 | 1/1968 | Mull | 118/259 |
| 3,504,626 | 4/1970 | Worthington | 101/148 |
| 3,585,932 | 6/1971 | Granger | 101/350 |
| 3,589,287 | 6/1971 | Woessner et al. | 101/363 |
| 3,712,031 | 1/1973 | Cruz . | |
| 3,818,830 | 6/1974 | Schultz | 101/350 |
| 3,898,955 | 8/1975 | Rosette et al. | 118/603 |
| 4,041,864 | 8/1977 | Dahlgren et al. | 101/350 |
| 4,158,333 | 6/1979 | Navi | 101/363 |
| 4,186,661 | 2/1980 | Vieau | 101/178 |

*Primary Examiner*—J. Reed Fisher
*Attorney, Agent, or Firm*—David H. Semmes

[57] ABSTRACT

Method of reducing air entrapment in rotary inking systems of the type wherein an inking cylinder rotates through an inking reservoir, including defining a plurality of curvate baffles transversely within said reservoir and tangentially with respect to the path of the inking cylinder, so as to squeeze entrapped air out of the ink; venting excess air from the reservoir and scraping the surface of the rotating cylinder after inking. A suggested diffusion structure includes a plurality of transverse rods positioned in the reservoir in an arcuate array tangential to the path of rotation of the inking cylinder, such that ink is "squeezed" between each rod and the rotating inking cylinder surface to force out entrapped air bubbles.

14 Claims, 5 Drawing Figures

METHOD AND APPARATUS FOR REDUCING AIR ENTRAPMENT IN ROTARY INKING SYSTEMS

CROSS-REFERENCE TO RELATED APPLICATIONS

An improvement upon the assignee's U.S. Pat. No. 4,158,333 for AN INKING BAFFLE FOR ROTARY NEWSPAPER PRESSES.

BACKGROUND OF THE INVENTION

1. Field of the Invention

Rotary newspaper printing presses of the type wherein an engraved surface roller is immersed within the ink reservoir and scraped by a doctor blade prior to its contact with a plate cylinder or rubber form friction driven rollers, as in the case of letterpress and offset systems. Particularly, baffle systems for improving the flow of ink within the reservoir and onto the surface of the rotating inking cylinder.

2. Description of the Prior Art

Being submitted separately under the provisions of 37 C.F.R. 1.97.

SUMMARY OF THE INVENTION

According to the present invention, entrapped air in the form of air bubbles is removed from the ink which is applied to the surface of the rotating inking cylinder. Conventionally, the amount of entrapped air is a function of web speed, that is, the speed of rotation of the inking cylinder within the inking reservoir. The faster the speed of rotation, the more air is entraped, due to the inertia of that layer of air which adheres to the surface of the rotating inking cylinder. This entrapped air results in dryness of the roller, such that the ink is unable to contact the inking cylinder surface in those areas where air bubbles have been entrapped. Alternatively, a group of entrapped air bubbles may be dislodged simultaneously from the inking cylinder surface, with the result that there is excessive "slugging" of ink in the void created by the discharged bubbles. Various attempts to avoid dryness or "slugging", such as vibrating the doctor blade, have been attempted without success.

According to the present invention, the entrapped air bubbles are virtually squeezed out of the ink by positioning a plurality of transverse rods within the reservoir in a circumferential array, tangential to the path of rotation of the inking cylinder. The distance between these rods and the rotating surface of the inking cylinder may be varied, according to varying speeds of ink cylinder rotation, ink viscosity and the like. The invention includes venting a portion of the entrapped air through the bottom of the reservoir prior to scraping with the doctor blade, as well as transversely partitioning the reservoir so as to inhibit lateral turbulence of the ink.

DESCRIPTION OF THE PREFERRED EMBODIMENTS

The present method and structure are devoted to the practical elimination of entrained air by "squeezing" the ink, so as to eject entrapped air bubbles, and by venting air from the bottom of the inking reservoir.

Figure 1:
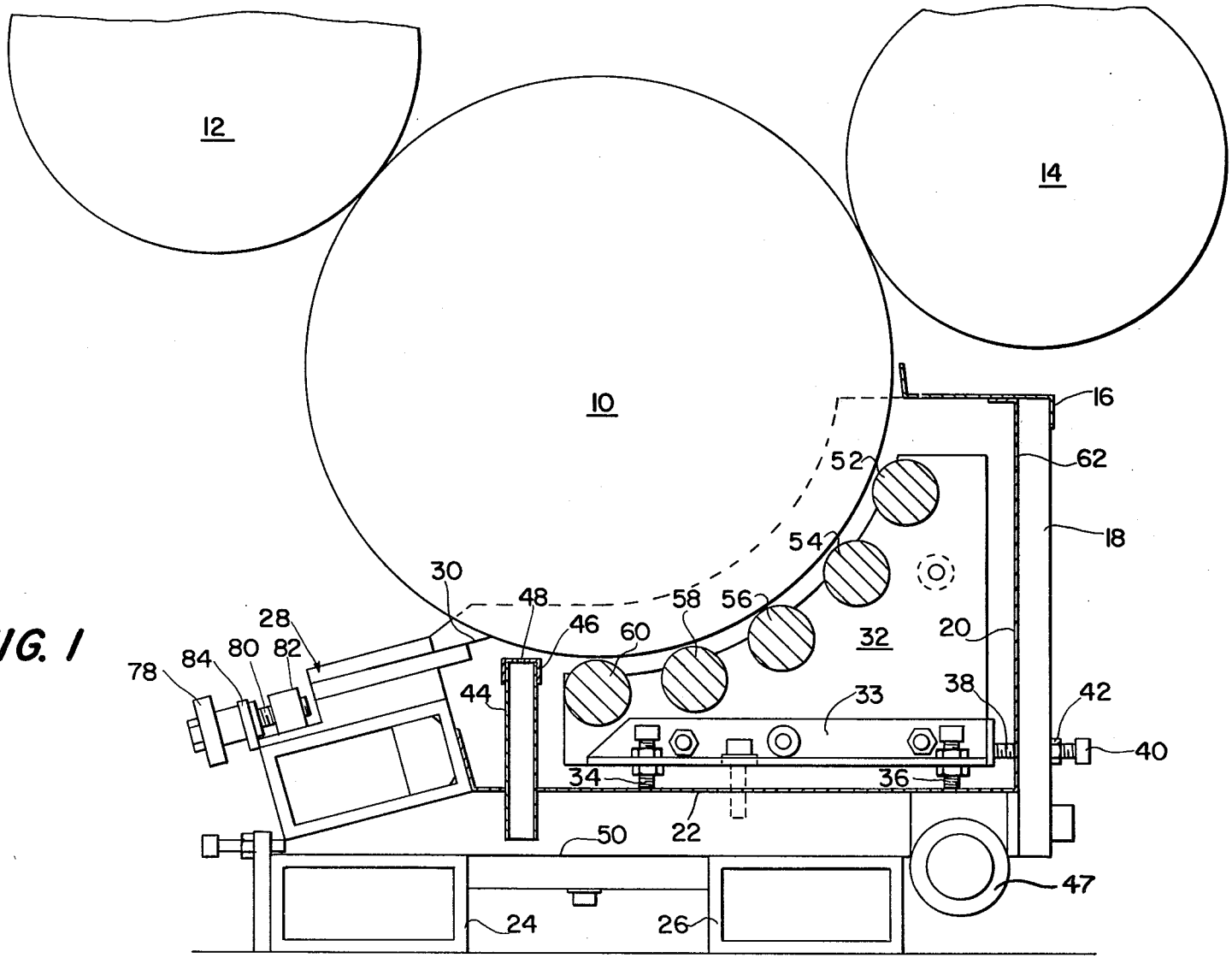
FIG. 1 is a side elevation of an inking system, according to the present invention, wherein an engraved inking cylinder, which contacts form rollers 12 and 14, rotates through an inking fountain tangentially with respect to a plurality of transversely disposed stationary rods.

In FIG. 1 an engraved inking cylinder, for example, of the "Anilox" type, having 200-360 ink repositroy cells per lineal inch, is shown rotating through inking reservoir 16 and contacting rubber form friction driven rollers 12 and 14. The ink reservoir 16 includes heavy rear plate 18, supporting inking fountain closure with bottom plate 22 in turn supported by solid member 50 and channels 24, 26 or the like.

A reverse angle doctor blade 30 is adjustably positioned within doctor blade holder assembly 28, while contacting the surface of inking cylinder 10, so as to scrape off excess ink.

A plurality of vertical diffusion plates or baffles 32 are mounted in diffusion structure bottom frame 32 and supported in superposed relationship with respect to the inking fountain bottom by means of screws 34 and 36. The diffusion structure may be longitudinally adjusted within the inking fountain 20 by means of socket head cap screw 40 and attached nut 42 with the threaded shank 38 of scan 40 abutting the frame 33. Socket head cap screw 64 may be provided to secure the baffle structure within inking fountain 20.

Figure 5:
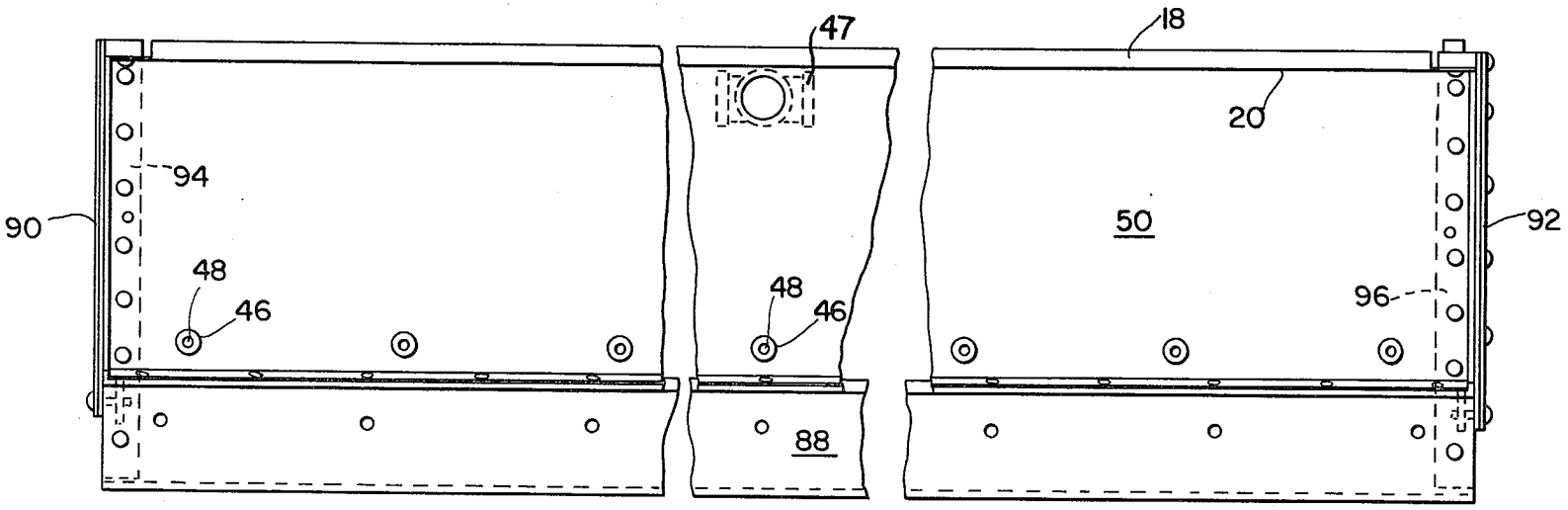
FIG. 5 is a top plan of the inking fountain with the diffusion structure removed, showing the individual air venting outlets extending vertically with respect to the bottom of the inking fountain and showing in phantom the ink inlet manifold 47.

As illustrated in FIGS. 1 and 5, a plurality of air venting and ink drain tubes 44 may be supported within the inking fountain, each tube 44 including vertically adjustable cap 46 with air venting aperture 48. The aperture 48 may be positioned slightly below engraved roller 10, so as to vent air during rotation of the inking cylinder and to drain ink during non-rotation of the inking cylinder.

Figure 2:
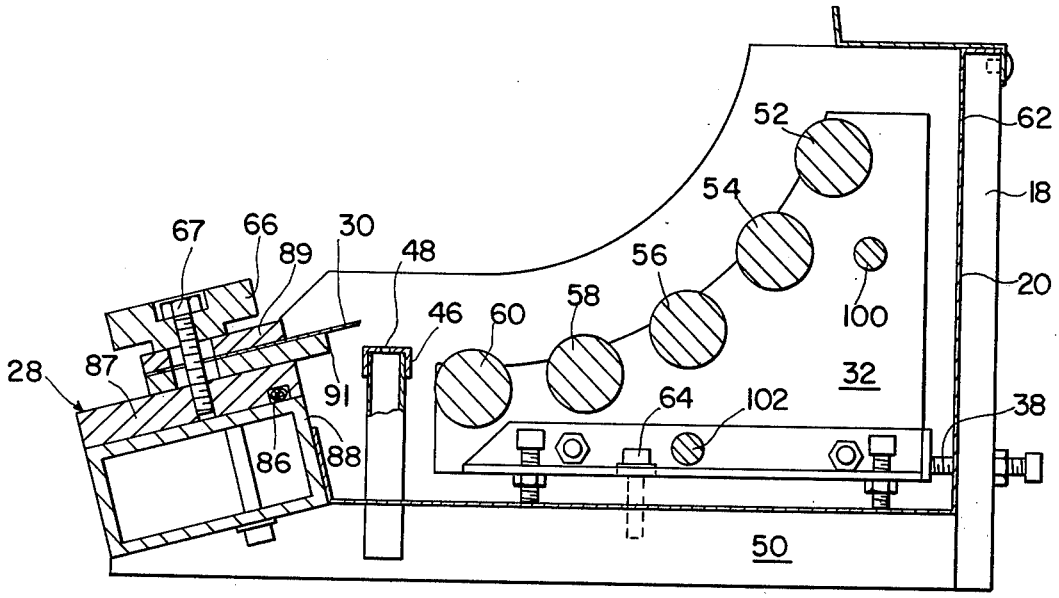
FIG. 2 is a sectional view through the inking fountain, showing the arcuate array of transverse rods, together with the air venting port and the doctor blade adjustment structure.
Figure 3:
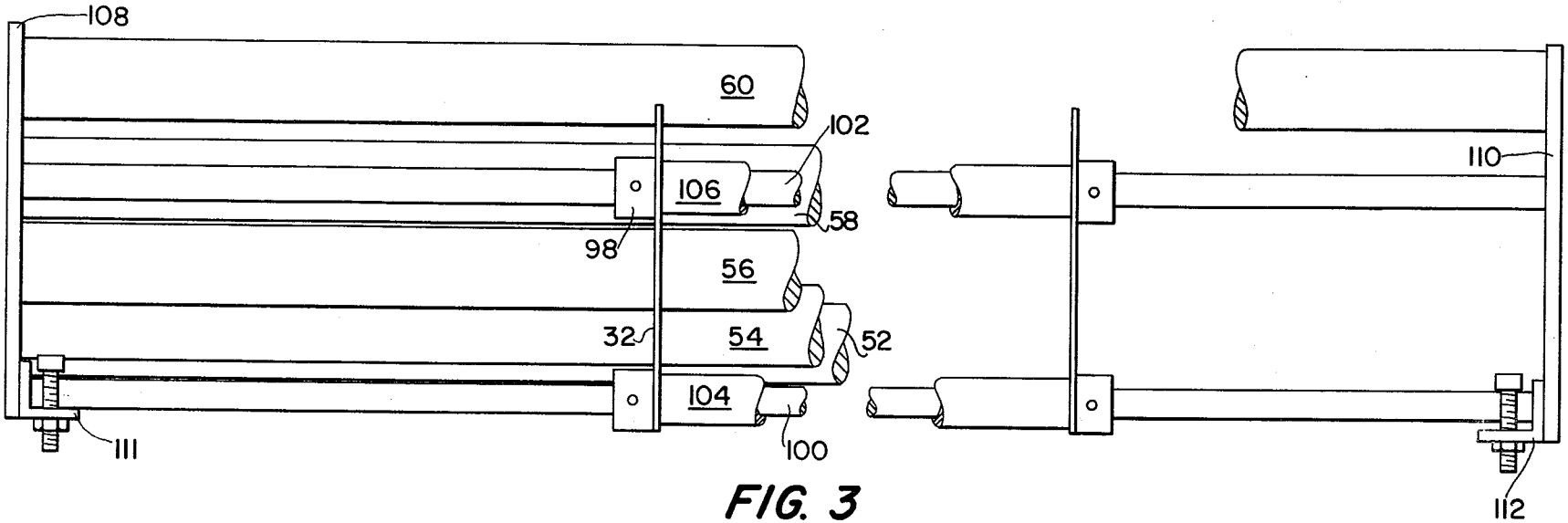
FIG. 3 is a partially fragmentary rear elevation of the diffusion structure, showing the transversely extending rods and the vertically disposed baffles or diffusion plates.

As illustrated in FIGS. 1, 2 and 3, a plurality of stationary, transversely extending rods 52, 54, 56, 58 and 60 are disposed in an circumferential array within the inking cylinder so as to be tangential to the path of rotation of cylinder 10 within the ink reservoir.

These rods 52, 54, 56, 58 and 60 are supported intermediate side plates 108 and 110, in turn stabilized by horizontal support bars 100 and 102. As illustrated in FIG. 2, the stability of the diffusion frame 33 is ensured additionally by socket head cap screw 64 extending into base 50.

One or more overflow ink drain apertures 62 may be defined at the top of rear panel 18, so as to discharge excess ink and maintain the reservoir at this prescribed level. Sequentially of draining, the surplus ink may be filtered to remove lint and then recirculated via a suitable filter and pump, thence through the manifold illustrated in phantom in FIG. 5. The constant recirculation and supply of filtered ink thus serves to temperature-stabilize the ink, while maintaining the desired ink level within the diffusion structure.

In FIG. 2 the doctor blade 30 adjusting blade assembly 89 is illustrated. The doctor blade is secured by means of a clamp screw hand knob 66, engaging threaded shaft 67, which extends through the doctor blade and threadedly engages member 87.

As illustrated in FIG. 1, longitudinal adjustment of assembly 28 is provided by means of blade adjusting knob 78 which is mounted upon threaded rod 80 extending into key 82 which is secured to the doctor blade clamp members 89, 91. As will be apparent, turning of knob 78 will actuate key 82, so as to move longitudinally the clamp members 89, 91 and doctor blade 30 with respect to the surface of the rotating inking cylinder 10.

Figure 4:
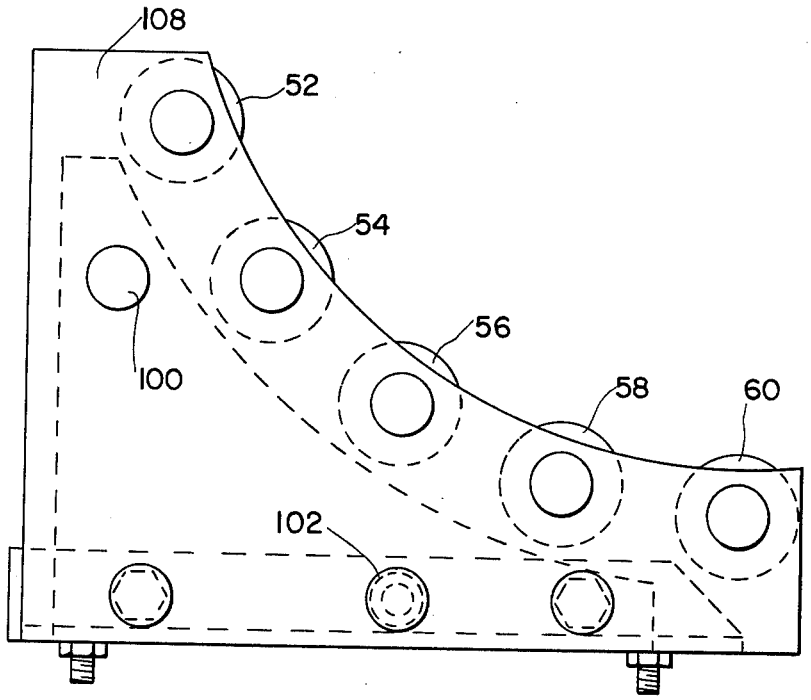
FIG. 4 is an end elevation of the diffusion structure.

In FIGS. 3 and 4 the array of transversely extending tubes or rods 52, 54, 56, 58 and 60 is shown as positioned between side plate members 108 and 110, rigidized in turn by support angles 111 and 112.

The diffusion panels or baffles 32 are shown as supporting the mid-section of the rods by means of appropriate set screw collar assemblies 98. The individual rods 100 and 102 may include mid-portion spacers, respectively, 104 and 106.

Manifestly, the higher the speed of rotation of cylinder 10, the more the entrapment of air, notwithstanding the positioning of the transverse rods. Accordingly, at higher speeds there is additional venting of air through air vent aperture 48, the size of which may be defined to accommodate higher speeds of rotation, while inhibiting the flow of ink therethrough. In the mode illustrated in FIG. 2, vent aperture 48 is positioned to vent air when inking cylinder 10 rotates at 850 rpm, approximating 2,000 feet of moving web per minute.

Conventionally, the entrapment of air results in dryness of the roller which is visibly detactable as spots which inhibit inking. Alternatively, the entrapment of air results in "slugging" of inproportionate amounts of ink. The use of transversely extending rods provides a nozzle shaped area adjacent the curvate surface of the inking cylinder, which literally squeezes the ink, and pushes away the air bubbles, such that the air bubbles may independently and freely move away from the rotating inking cylinder surface. After this squeezing, the ink is pulled downwardly in the reservoir along the inking cylinder surface for further distribution against the inking cylinder surface by doctor blade 30. The remaining air which is entrained, nothwithstanding the squeezing, may be vented through aperture 48. Overflow ink may be drained through vent tube 48 under low speed or non-operating circumstances and, also, through one or more outlets 62 defined at the top of the inking reservoir.

Manifestly, the array and configuration of stationary rods may be varied without departing from the spirit of the invention.

We claim:

1. A method of reducing air entrapment in rotary inking systems of the type embodying an inking cylinder rotatable through an ink reservoir and scraped by a doctor blade upon leaving the reservoir, comprising:

A. Flowing ink through an ink reservoir;

B. Rotating an inking cylinder within said reservoir, so as to ink the surface of said cylinder;

C. Squeezing said flowing ink so as to remove entrapped air adjacent the inking cylinder surface by definig a plurality of transversely extending cylindrical surfaces in a circumferential array complementary and adjacent to the path of rotation of the inking cylinder within the reservoir;

D. Venting entrapped air through the bottom of said reservoir; and

E. Scraping excess ink from the surface of said cylinder.

2. Method of reducing air entrapment in rotary inking systems as in claim 1, wherein said plurality of transversely extending cylindrical surfaces are longitudinally spaced with respect to each other along the path of rotation.

3. Method of reducing air entrapment in rotary inking systems as in claim 2, including varying the amount of venting of said air according to the speed of rotating said inking cylinder.

4. Method of reducing air entrapment in rotary inking systems as in claim 3, including draining excess ink from said reservoir simultaneously with venting of air.

5. Method of reducing air entrapment in rotary inking systems as in claim 3, including adjusting the distance between said transversely extending cylindrical surfaces and said inkin cylinder, according to ink viscosity.

6. Method of reducing air entrapment in rotary inking systems as in claim 2, including adjusting the distance between said transversely extendig cylindrical surfaces and said path of rotation, according to the speed of rotation of said cylinder.

7. Method of reducing air entrapment in rotary inking systems as in claim 6, including venting air through the top of said reservoir.

8. An ink reservoir of the type used in a printing system embodying a rotatable inking cylinder contactable with printing ink within an inner reservoir comprising:

A. A frame;

B. An ink fountain defined as an enclosure supported in said frame, so as to abut the path of rotation of the inking cylinder;

C. A doctor blade supported on one side of said frame, so as to contact the inking cylinder surface sequentially of rotation through said ink reservoir; and D. A diffusion structure supported in said fountain and including:

i. a plurality of transverse rods supported in a circumferential array within said structure and tangential to the path of rotation of the inking cylinder.

9. An ink reservoir of the type used in a printing system as in claim 8, said diffusion structure further including:

ii. at least one vertical baffle supported perpendicularly with respect to said transverse rods.

10. An ink reservoir as in claim 9, said reservoir including a vertically extendig air venting tube supported in said ink fountain adjacent said doctor blade.

11. An ink reservoir as in claim 10, said diffusion structure being laterally and vertically adjustable within said inking fountain.

12. An ink reservoir as in claim 11, said ink fountain including an ink draining outlet adjacent said vertical baffle.

13. An ink reservoir as in claim 12, said diffusion structure being superposed with respect to said ink fountain bottom and sides, so as to permit flow of ink.

14. Method of reducing air entrapment in rotary inking systems as in claim 4, including recirculating said ink, sequentially of said draining.

* * * * *